US005676797A

United States Patent [19]

Barsin et al.

[11] Patent Number: 5,676,797

[45] Date of Patent: Oct. 14, 1997

[54] APPARATUS FOR REMOVING HIGH-VOLUME, LOW CONCENTRATION NON-CONDENSABLE GASES PRODUCED IN A KRAFT PULPING PROCESS

[75] Inventors: Joseph A. Barsin, Charlotte; Bo O. Oscarsson, Huntersville, both of N.C.; David Smith, Vancouver, Canada

[73] Assignee: Kvaerner Pulping Technologies AB, Sweden

[21] Appl. No.: 422,310

[22] Filed: Apr. 13, 1995

[51] Int. Cl.[6] ..... D21C 11/06; D21C 11/14

[52] U.S. Cl. ..... 162/240; 431/123; 431/161; 431/187

[58] Field of Search ..... 431/123, 161, 431/187, 188, 207, 208, 5; 162/15, 31, 51, 240

[56] References Cited

U.S. PATENT DOCUMENTS

| | | | |
|---|---|---|---|
| 3,396,076 | 8/1968 | Crosby et al. . | |
| 3,520,772 | 7/1970 | Lindberg . | |
| 3,828,700 | 8/1974 | Ragot | 431/5 |
| 3,836,315 | 9/1974 | Shular | 431/188 |
| 4,156,590 | 5/1979 | Pariani | 431/123 |

FOREIGN PATENT DOCUMENTS

| | | | |
|---|---|---|---|
| 139233 | 12/1978 | Japan | 431/5 |

OTHER PUBLICATIONS

Lindberg, "How Uddeholm Destroys Air and Water Pollutants at the Skoghall Works," Svensk Papperstidning arg. 69, Aug. 15, 1966, pp.484–487.

*Primary Examiner*—Matthew O. Savage
*Attorney, Agent, or Firm*—Ronald P. Kananen

[57] ABSTRACT

An apparatus for introducing a high volume, low concentration non-condensable gas, which may contain sulfur into a chemical recovery steam generator furnace comprising: a plurality of gas inlet pipes, each gas inlet pipe having a source end and a nozzle end, in which the source end of the pipe is connected to a source of said high volume, low concentration non-condensable gas and the nozzle end of the pipe, which comprises a nozzle, vents to said chemical recovery steam generator furnace; a preheater positioned in close proximity to said pipe and upstream of said nozzle; a secondary air port with a source end and a furnace end, in which the source end of said port is connected to a source of such secondary air and the furnace end of said port vents to said chemical recovery steam generator furnace; wherein the area enclosed by said secondary air port is greater than the area of said nozzle and wherein said nozzle is positioned within the area enclosed by said secondary air port such that said pipe and said port are substantially co-axial with respect to one another is described.

9 Claims, 4 Drawing Sheets

APPARATUS FOR REMOVING HIGH-VOLUME, LOW CONCENTRATION NON-CONDENSABLE GASES PRODUCED IN A KRAFT PULPING PROCESS

BACKGROUND OF THE INVENTION

1. Field of the Invention

The present invention relates to an apparatus and a process for removing high-volume, low-concentration non-condensable gases produced in a kraft pulping process.

2. Background of the Invention

Pulp is a fibrous product derived from cellulosic fiber-containing materials used in the production of hardboard, fiberboard, paperboard, paper, and molded-pulp products. The objective of wood pulping is to separate the cellulose fibers one from another in a manner that preserves the inherent fiber strength while removing as much of the lignin, extractives, and hemicellulose materials as required by pulp end-use considerations. Wood is converted to pulp by a combination of mechanical and chemical steps which constitute the pulping process.

Pulping begins with receipt of the wood at the mill site. Pulp logs are conveyed to the debarking area, where they are cut to the proper length, if necessary, and sorted. Accepted logs are mechanically fed into a bark remover. Removed bark is collected, shredded, and used as a fuel in steam boilers. The debarked wood is conveyed to a chipper for conversion into chips of the proper length for chemical treatment in a subsequent cooking operation. This cooking can be accomplished in either a batch digester or a continuous digester. In the digestion process, screened chips are conveyed from storage to a chip-supply bin associated with the digester. Chips feed by gravity from the bin to a chip meter, the speed of which determines chip and cooking liquor flow rates to the digester and pulp discharge rate. Metered chips drop to a low-pressure feeder valve, through which the chips are introduced into a steaming vessel, where the chips are preheated, air is expelled from the chip interior for impregnation, and chip moisture content leveled in preparation for impregnation with cooking liquor. Cooked chips are continuously being removed from the bottom of the digester and other chips pass downwards from above in the digester, replacing those discharged. As cooked chips reach the bottom zone of the digester, they are plowed to a central well in the bottom of the digester while being mixed with filtrate from the pulp washer for cooling. Mechanical forces exerted in the transfer of the chips from the digester to the blow tank effect fiberization of the chips. This fibrous material collected in the blow tank is called pulp. The pulp (brown stock) discharged to the blow tank is in admixture with black liquor, a water solution of spent and residual cooking chemicals and dissolved wood materials. The fiber bundles left in the pulp after blowing must be fiberized, i.e., separated into discrete fibers, and the black liquor removed in order for the pulp to be refined and formed into a fiber sheet on the linerboard machines. Pulp is diluted with filtrate from the pulp washer and fed to a fibrilizer which serves the purpose of metal trapping, fiber-bundle breaking, rough screening, and pumping. Removal of the black liquor from screened brownstock is usually accomplished on rotary drum vacuum filters, arranged for multistage countercurrent washing. At various points in this process, the woody material may be bleached by treatments with a variety of oxidizing agents.

During the pulping process, the reaction of the wood materials with various chemical components results in the production of numerous gaseous products. These gaseous products are released from a number of sources. For example, the digester vents gases during heating. A further source is digester blow gases which are emitted when pressure is released upon completion of the digestion cycle. Further liberation of gases occurs during evaporation of the black liquor. Additionally, some gases are released during brownstock washing.

Because of the nature of the chemical agents that are commonly employed in the pulping process, these gaseous products often contain a variety of sulfur compounds, including various mercaptans. Some of these sulfur compounds are malodorous, while others are toxic. Environmental concerns prohibit the release of these gases to the atmosphere and require that the gaseous products be collected and processed.

The gases generated during the pulping process may be classified into two categories: a high concentration, low volume stream (HCLV) and a high volume, low concentration (HVLC) stream. The first stream, having a high concentration of organic components and a small volume, resembles natural gas in that it can undergo self-sustaining combustion. Thus the sulfur compounds can be readily burnt off and this gaseous stream is easily disposed. The second stream, having a low concentration of organic components and a high volume, has been more problematic. This gas is predominantly air admixed with a small amount of organic materials, including sulfur compounds. This gaseous stream will normally contain approximately 5 to 6% by volume of various mercaptans.

Conventionally, HVLC non-condensable gas streams had been vented to power boilers to be incinerated with the base fuel feeding the boilers. However, because the HVLC gaseous streams contained various sulfur oxides, which are extremely corrosive, this approach resulted in internal corrosion of the pipes in the gas supply system to the power boilers. This corrosion resulted in leakage from the supply system and hazardous release of these gases.

Further, in such systems the power boiler itself is not designed for corrosive gases and the low temperature end, including the economizer and air heater, suffers accelerated corrosion. Also, high temperature corrosion in the furnace is also accelerated, all of which shortens the life of the power unit and increases maintenance expenses.

This disposal method is not economical because in some systems the method mandates that the power boiler rely upon natural gas to stabilize the flame and to provide a heat sink, ensuring stable combustion during the normally fluctuating HVLC flow. Moreover, in most modern pulping systems the recovery boiler is self-sufficient with regard to steam generation. Thus, the output of a power boiler is no longer necessary. Thus, conventional processes of treating HVLC gases could require the operation and maintenance of an unnecessary steam generator and the expense of fuel employed to stabilize the flame in the furnace of the steam generator.

An alternate approach to handling the HVLC non-condensable gas stream was to vent the stream to a recovery boiler for incineration. It was believed that, because recovery boilers were designed to handle corrosive gases, this approach would successfully process the HVLC gases. Accordingly, corrosion occurred upstream in the carbon steel conveying pipes. Also, because the single large vent hole in the furnace wall was not a stable flame front, it was common to ignite/reignite, occasionally with an explosion. In addition, the asymmetrical inlet had an adverse effect upon the main firing system for black liquor and the ability to control a char bed. Further, natural variations in flow from gasses produced by a process occured and there was no attempt made to control flow and relate it to the main fuel input.

Various approaches to processing the HVLC stream have been exemplified in the prior art.

U.S. Pat. No. 3,520,772 to Lindberg discloses a process for removing malodorous air and water pollutants produced in alkaline pulp cooking in which polluting gases are routed to a furnace via a single furnace feed without passing through a condenser. In an optional embodiment, the gases pass through a superheater on the route to the furnace.

U.S. Pat. No. 3,396,076 to Crosby et al discloses a method of recovering chemical values from the alkaline effluent resulting from the bleaching stage of the kraft pulping process. In this process the relief gas from the digester, the blow tank, the evaporator, and the finisher are routed to the primary zone of the recovery furnace by means of a single supply port.

In Svensk Papperstidning årg. 69, Nr. 15, page 484–487 (Aug. 15, 1966), Lindberg describes procedures implemented at the Skoghall sulfate mill to eliminate malodorous air and water pollutants. In this process the non-condensable relief gases from the digester pass a steam injector and are introduced into the recovery furnace by means of a single supply port just above the tertiary air intake.

However, the conventional methods of the prior art did not correct the problems of corrosion, foul odors, high emissions, and explosive re-ignition associated with simple venting of the relief gases from the pulping process to the furnace of a chemical recovery steam generator.

Thus, there remains a need for a well-engineered safe system for processing HVLC gases produced during the pulping process.

SUMMARY OF THE INVENTION

Accordingly, an object of the present invention is to provide a novel apparatus for introducing a high volume, low concentration (HVLC) non-condensable gas into a chemical recovery steam generator furnace.

A further object of the present invention is to provide a process for treating a high volume, low concentration (HVLC) non-condensable gas generated during kraft pulping and which may contain sulfur, which process substantially reduces the possibility of explosive reignition, corrosion, foul odors, and high emissions.

These objects and others have been obtained by an apparatus for introducing a high volume, low concentration non-condensable gas into a chemical recovery steam generator furnace comprising a plurality of gas inlet pipes, each gas inlet pipe having a source end and a nozzle end, in which the source end of the pipe is connected to a source of said high volume, low concentration non-condensable gas and the. nozzle end of the pipe, which includes a nozzle, vents to said chemical recovery steam generator furnace; a preheater positioned in close proximity to said pipe and upstream of said nozzle; a secondary air port with a source end and a furnace end, in which the source end of said port is connected to a source of such secondary air and the furnace end of said port vents to said chemical recovery steam generator furnace; wherein the area enclosed by said secondary air port is greater than the area of said nozzle and wherein said nozzle is positioned within the area enclosed by said secondary air port such that said pipe and said port are substantially co-axial with respect to one another such that the gas is aspirated into said furnace by said secondary air. Additionally, the above objects and others have been achieved with a process for treating a high volume, low concentration non-condensable gas produced during a pulping process, comprising the steps of preheating said high volume, low concentration non-condensable gas; conveying said preheated gas to a plurality of gas inlet pipes; each gas inlet pipe having a source end and a nozzle end, in which the source end of the pipe is connected to a source of said high volume, low concentration non-condensable gas and the nozzle end of the pipe, which includes a nozzle, vents to said chemical recovery steam generator furnace; conveying said preheated gas through the nozzle to the furnace such that the gas is oxidized, wherein said nozzle is positioned relative to a secondary air port with a source end and a furnace end, in which the source end of said port is connected to a source of such secondary air and the furnace end of said port vents to said chemical recovery steam generator furnace; such that the area enclosed by said secondary air port is greater than the area of said nozzle and wherein said nozzle is positioned within the area enclosed by said secondary air port such that said pipe and said port are substantially co-axial with respect to one another.

BRIEF DESCRIPTION OF THE DRAWINGS

A more complete appreciation of the invention and many of the attendant advantages thereof will be readily obtained as the same become better understood by reference to the following detailed descriptions when considered in connection with the accompanying drawings, in which.

DETAILED DESCRIPTION OF THE PREFERRED EMBODIMENTS

Figure 1:
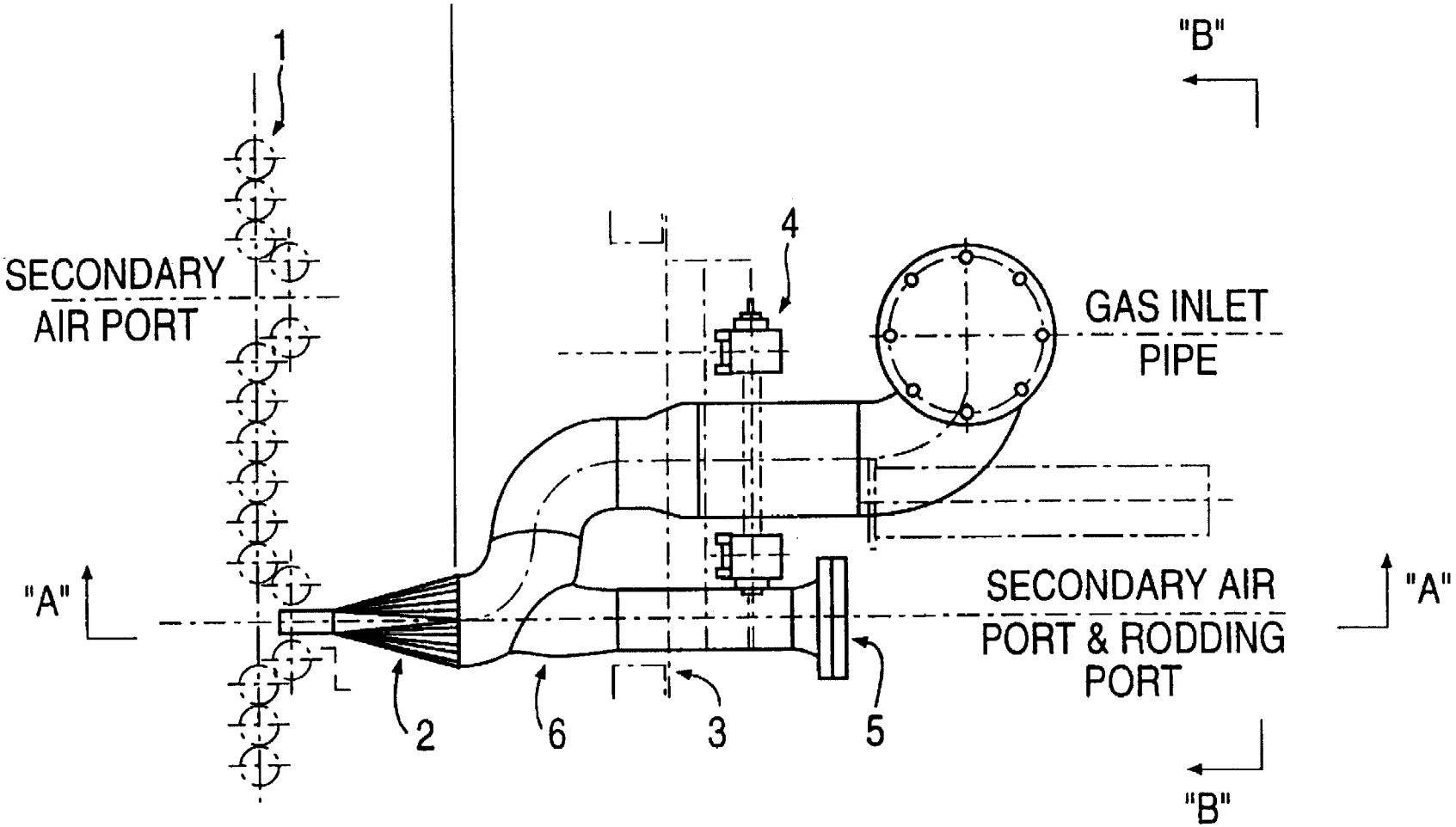
FIG. 1 depicts a plan view of a gas pipe for introducing a high volume, low concentration non-condensable gas into a chemical recovery steam generator furnace.
Figure 2:
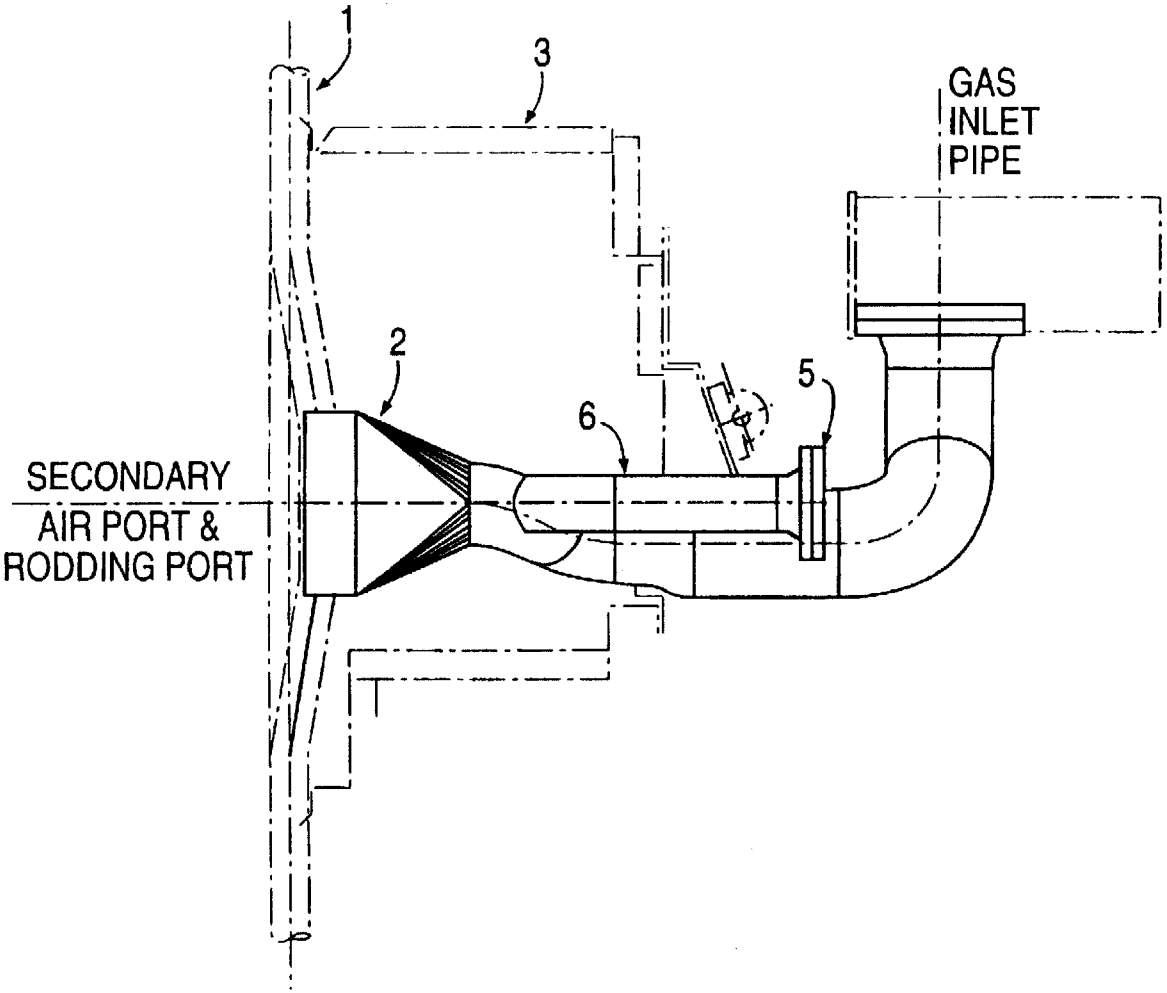
FIG. 2 depicts a section along line A—A in FIG. 1.
Figure 3:
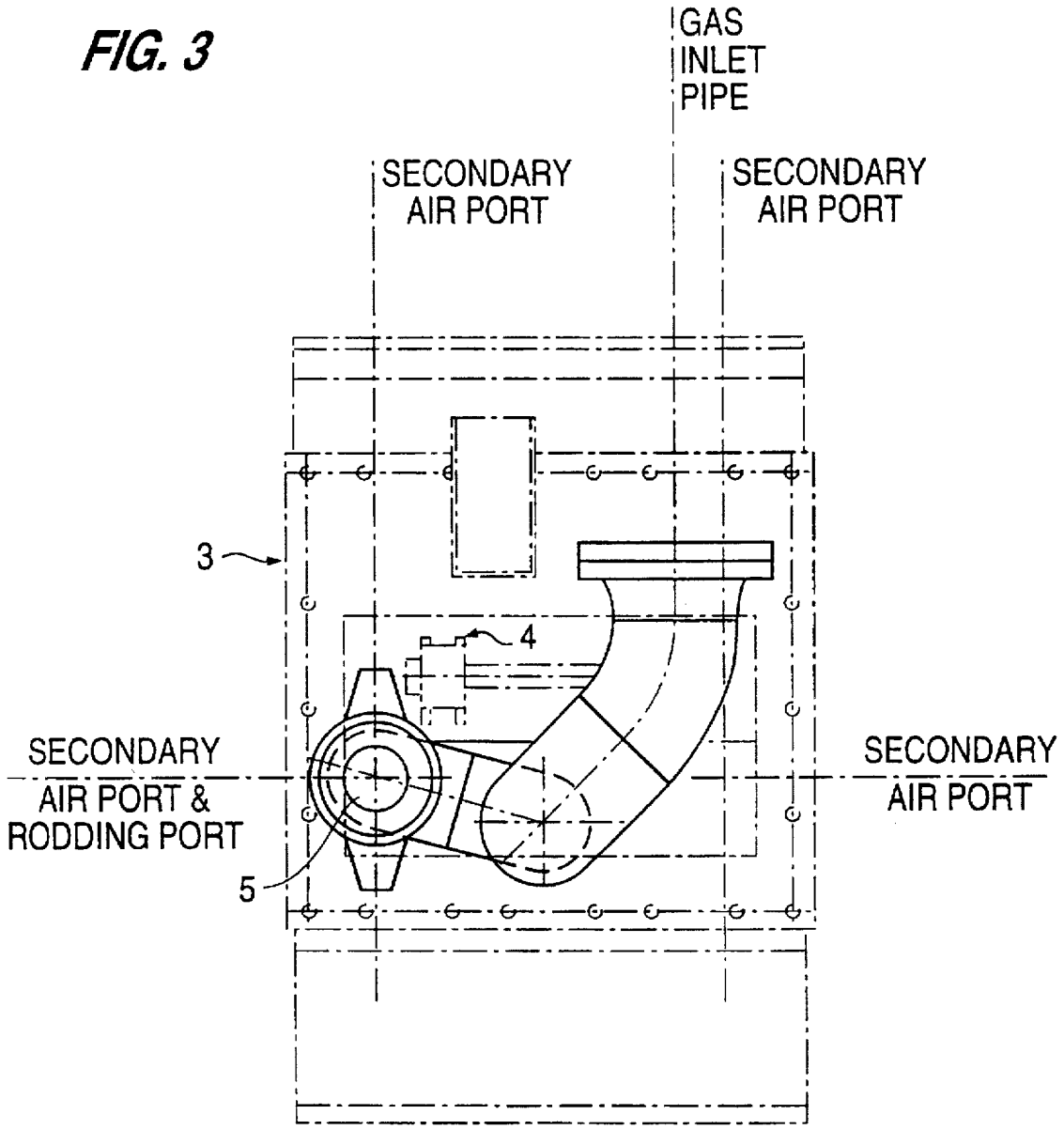
FIG. 3 depicts a section along line B—B in FIG. 1.

Referring now to the drawings, wherein like reference numerals designate identical or corresponding parts throughout the several views, and more particularly to FIG. 1 thereof, numeral 1 represents the wall of the furnace of the chemical recovery steam generator, which in a preferred embodiment is constructed from tubes which can contain a mixture of steam and water. Numeral 2 represents the nozzle. Numeral 3 depicts the edge of the wind box. Numeral 4 represents a valve for closing off the gas inlet pipe from the nozzle, which valve permits cleaning of the nozzle. Numeral 5 depicts a flange, which can be removed to allow entry to access clean-out pipe 6 during nozzle cleaning.

Proper incineration of HVLC non-condensable gases can occur, if a system is employed which avoids the pitfalls found in conventional incineration attempts that used the chemical recovery steam generator furnace as the "dump spot," the point to which the HVLC non-condensable gases were routed.

A major problem in the past was extensive corrosion of the HVLC non-condensable gas transport and delivery system. As the system corroded, highly malodorous components escaped from the system to the enclosed recovery work spaces. A second pitfall was a failure to distribute and disperse the gases as they were fed into the furnace; all were vented through a single opening on the furnace side wall. A third shortcoming was condensation and subsequent introduction of condensate and water into the recovery furnace. Entry of water into the furnace in this fashion can result in a catastrophic smelt water reaction. A fourth common pitfall was an absence of any interlocks on the delivery system, which interlocks could divert the HVLC non-condensable gas to an alternate destination such as a kiln, power boiler or vent stack if the support load or the HVLC non-condensable gas temperature was too low. Additionally, conventional HVLC non-condensable gas incineration had made no provision to provide access to the HVLC non-condensable gas ports for inspection and cleaning of the HVLC non-condensable gas delivery system.

Other features of the invention will become apparent in the course of the following descriptions of exemplary embodiments which are given for illustration of the invention and are not intended to be limiting thereof.

In one embodiment of the present invention, the HVLC non-condensable gas is supplied to the furnace of the chemical recovery steam generator by means of a plurality of nozzles, which nozzles are arranged as close to symmetrically as possible around the furnace walls. In a preferred embodiment, the HVLC non-condensable gas nozzles are distributed symmetrically with the secondary air ports. In a more preferred embodiment there are 10 HVLC non-condensable gas nozzles arranged with 5 HVLC non-condensable gas nozzles on the front wall of the furnace and 5 HVLC non-condensable gas nozzles on the rear wall of the furnace. The symmetrical arrangement of the HVLC non-condensable gas nozzles ports permits an even distribution of the gases around the furnace, reduces TRS spikes and aids in flame stabilization. In addition, the symmetrical distribution of nozzles minimizes the destabilizing effect these high volume gases previously had upon bed formation and furnace mixing. Further, if sulfur is present in the gas, injection of such gases permits the recovery of the sulfur which otherwise would be lost to the process.

In another embodiment of the present invention, a preheater is installed in the HVLC non-condensable gas supply line to the furnace upstream of the valve. This preheater comprises one or more methods of heating the fluid in the HVLC non-condensable gas supply line. Such methods include heating by means of electrical resistance, heating by means of a heated fluid surrounding the HVLC non-condensable gas supply line, and heating by means of a independent heat source such as an indirect fired heater. Such methods are appropriately described in the conventional literature. In a more preferred embodiment, the preheater maintains the HVLC non-condensable gas at an exit temperature of 300° F.

In another embodiment of the present invention, the HVLC non-condensable gas supply to the furnace is provided with interlocks, which interlocks can either prevent the introduction of the HVLC non-condensable gas into the chemical recovery steam generator or divert the HVLC non-condensable gas to an alternate destination such as a kiln, power boiler or vent stack if the support load or the HVLC non-condensable gas temperature is too low. The interlock system comprises either means for switching on or off the HVLC non-condensable gas supply to the one or more gas inlet pipes or means for switching the HVLC non-condensable gas supply line from supplying the gas to the one or more gas inlet pipes to supplying the gas to an alternate destination and back again. Such interlocks operate by monitoring either the support load/temperature or the lower explosion limit (LEL) of the HVLC. The interlock is installed in the HVLC non-condensable gas supply line upstream of the nozzle. Appropriate monitoring and switching systems are conventionally described in the literature.

The combination of preheater and interlock reduces the risk of condensation in the HVLC non-condensable gas supply and, thus, avoids the introduction of water into the furnace.

In yet another embodiment of the present invention, the HVLC non-condensable gas is routed to the furnace of the chemical recovery steam generator only when the generator is operating at a level of at least 60% of the maximum continuous power rating of the chemical recovery steam generator. At those periods when the rating of the generator is below 60% of the maximum continuous rating, the HVLC non-condensable gas is alternately routed to a vent stack, kiln or power boiler. This procedure assures a stable heatsink for the gases and eliminates the risk of flame-out and explosive re-ignitions.

In addition, the HVLC non-condensable gas nozzles are arranged in the secondary zone of the furnace and each port is sized to fit within an area enclosed by a secondary air port, thus permitting secondary air to totally surround the HVLC non-condensable gas stream. This design provides aspiration of the HVLC non-condensable gas such that the combination of secondary air port and gas nozzle acts as an injector for the HVLC non-condensable gas into the furnace.

Figure 4:
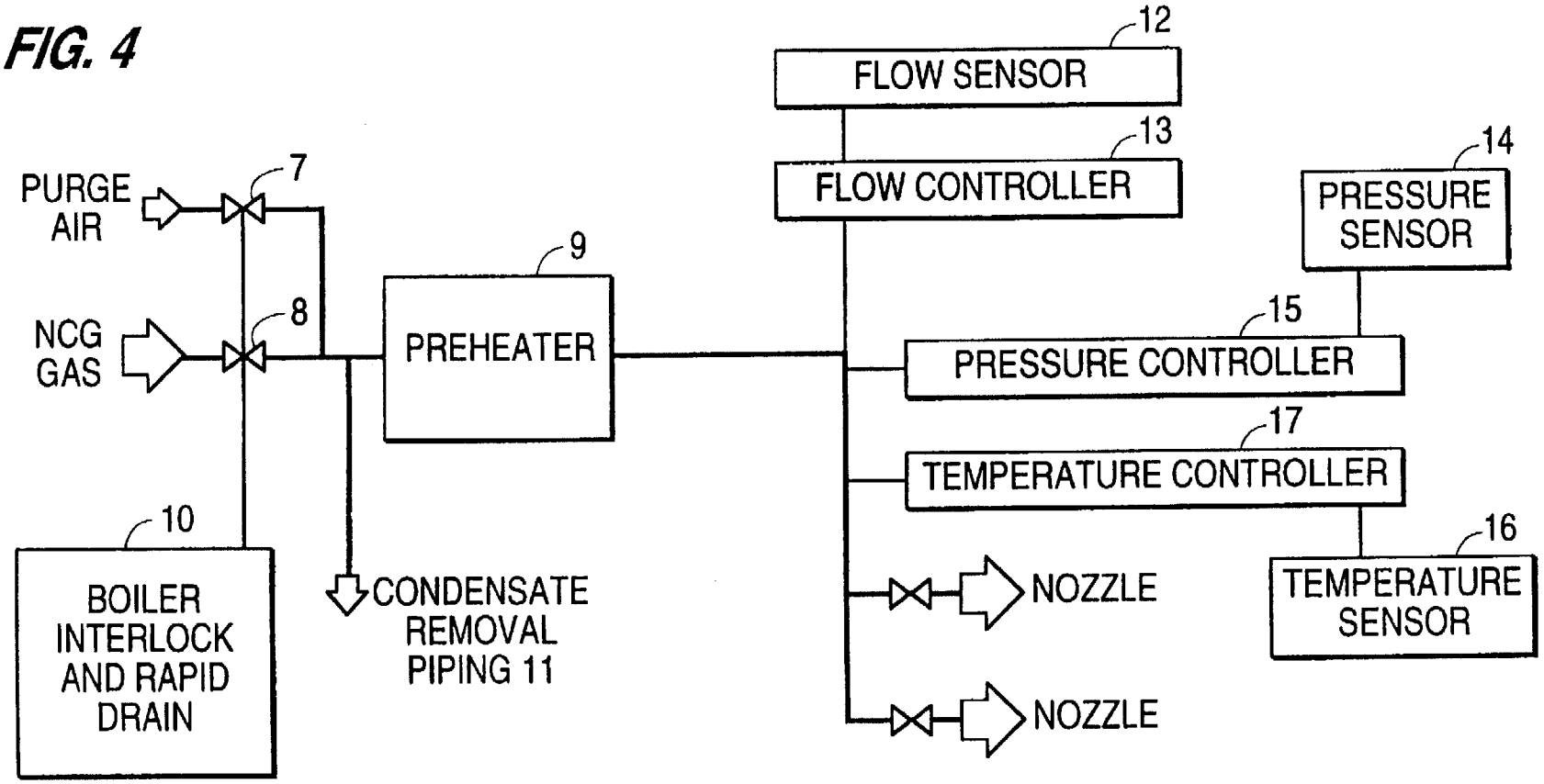
FIG. 4 depicts a block diagram of an embodiment of the HVLC NCG system.

FIG. 4 is a block diagram showing an embodiment of the HVLC NCG System. In this embodiment, the gas shutoff valves 7 and 8 are positioned prior to the preheater which preferably is a Steam Coil Gas Heater (SCGH) 9 and are controlled by the boiler protective interlock and rapid drain system 10. Any condensate formed in the transfer piping from the different sources is collected and removed through the condensate removal piping 11 which is positioned prior to the preheater 9. The preheater 9 heats the HVLC-NCG gas to well above its dew point and to a temperature that satisfies the furnace conditions in the recovery boiler. The gas flow is monitored by a flow sensor 12 and controlled by flow controller 13 and is not allowed to exceed a present maximum condition. The gas pressure is monitored by a pressure sensor 14 and controlled by pressure controller 15 and is kept within preset safe conditions. The gas temperature is monitored by temperature sensor 16 and controlled by temperature controller 17 and is not allowed to drop below a preset safe condition.

It should be noted that the chemical recovery stage is characterized by the large number of particulates generated by the combustion process, which particulates can plug the nozzles of the gas supply pipes. The present invention provides each gas supply line with a valve and a clean-out, which allows each nozzle to be shut off individually and to be cleaned individually.

In another embodiment of the present invention, each gas inlet pipe is provided with a clean-out leg to permit cleaning and rodding. In a preferred embodiment of the invention, each gas inlet pipe is equipped with an automated port rodding system or a shut-off valve to permit cleaning and rodding of the nozzle while the furnace is in operation.

In another preferred embodiment of the present invention, the system limits the input of the HVLC non-condensable gas to no more than 20% by volume of the total gas flow to the boiler. This is accomplished by means of a flowmeter regulating the volume of the HVLC non-condensable gas to 20% or less by volume relative to the volume of the total air flow of combustion air to the boiler. Such a flowmeter provides means for monitoring the total gas flow to the furnace and the HVLC non-condensable gas flow and means for regulating the HVLC non-condensable gas flow such that the HVLC non-condensable gas flow does not exceed 20% by volume of the total gas flow to the furnace. The flowmeter is installed in the HVLC non-condensable gas supply line upstream of the nozzle. Appropriate means for monitoring and regulating gas flow are described in the conventional literature.

Because the HVLC non-condensable gas is corrosive and wet, it is preferred that the system supplying this gas stream to the chemical recovery steam generator is constructed from stainless steel piping.

In a particularly preferred embodiment, the HVLC non-condensable gas is introduced by means of a plurality of gas supply pipes symmetrically arranged (as permitted on retrofits) around the periphery of the furnace and positioned near the hottest combustion zone, in contrast to conventional gas supply arrangements which routed the gas through a single opening.

In the present invention the area of the secondary air port is larger that the nozzle of the gas supply pipe and the nozzle introducing the HVLC non-condensable gas is positioned such that the secondary air stream issuing from the secondary air port surrounds and forms an annulus around the HVLC non-condensable gas stream. In a preferred embodiment, the center-line of the nozzle is arranged approximately with the center-line of the secondary air port. The result of this arrangement of the secondary air port and the nozzle is that the secondary air acts as an aspiration jet, distributing and mixing the HVLC non-condensable gas.

Normally, the windbox which supplies the air to the secondary air port is maintained at an air pressure of approximately 10 inches of water. On the other side of the secondary air port, the air pressure is approximately negative ½" of water. Thus, there is a differential head pressure between the windbox and the furnace.

Modifications and variations of the present invention are possible in light of the above teachings. It is therefore to be understood that within the scope of the appended claims, the invention may be practiced otherwise than is specifically described herein.

What is claimed is:

1. In combination with a chemical recovery steam generator furnace adapted to recover treatment chemicals from the combustion of black liquor generated in a pulping process and to generate steam from heat produced during said combustion, an apparatus for introducing a high volume, low concentration non-condensable gas produced by said pulping process into said furnace comprising:

a plurality of gas inlet pipes, each gas inlet pipe having a source end for connection to a source of said high volume, low concentration non-condensable gas and a nozzle including an orifice positioned proximate a combustion zone of said furnace for introducing said high volume, low concentration non-condensable gas into said combustion zone;

a pre-heater positioned in close proximity to said plurality of gas inlet pipes and upstream of said nozzles for heating said high volume, low concentration non-condensable gas;

a plurality of secondary air ports in a wall of said furnace, each said secondary air port being associated with a respective one of said nozzles and having a source end and a furnace end, the source end of each said secondary air port being adapted for connection to a source of secondary air and the furnace end of each said secondary air port including an orifice positioned adjacent said combustion zone for introducing secondary air into said combustion zone;

wherein a cross sectional flow area of each said secondary air port is greater than a cross sectional flow area defined by the orifice of a respective said nozzle, and wherein each said nozzle is coaxially positioned within the respective secondary air port whereby a flow of said secondary air from the source end to the furnace end of said secondary air port aspirates said high volume, low concentration non-condensable gas from the orifice of said nozzle.

2. The apparatus according to claim 1, wherein said plurality of gas inlet pipes are arranged symmetrically around the recovery furnace.

3. The apparatus according to claim 1, wherein said preheater heats said high volume, low concentration non-condensable gas to an exit temperature of at least 300° F.

4. The apparatus according to claim 1, wherein each said gas inlet pipe includes a valve for shutting off the flow of said high volume, low concentration non-condensable gas to a respective said nozzle.

5. The apparatus according to claim 1, further comprising an interlock means for preventing the introduction of said high volume, low concentration non-condensable gas through said gas inlet pipes into said recovery furnace.

6. The apparatus according to claim 5, wherein said interlock means comprises means for conveying said high volume, low concentration non-condensable gas to the recovery furnace only when the furnace is operating at a level of at least 60% of the maximum continuous rating of the recovery furnace.

7. The apparatus according to claim 1, further comprising means for limiting the amount of said high volume, low concentration non-condensable gas introduced to the recovery furnace to no more than 20% by volume of the total gas flow to the furnace.

8. The apparatus according to claim 1, wherein each of said gas inlet pipes further comprises an access clean-out leg to permit cleaning and rodding of a respective said nozzle.

9. The apparatus according to claim 1, wherein said source of high volume, low concentration gas contains sulfur.

* * * * *